US005524414A

United States Patent [19]

Spada et al.

[11] Patent Number: 5,524,414

[45] Date of Patent: Jun. 11, 1996

[54] MACHINE FOR PACKAGING FRAGILE CYLINDRICAL PRODUCTS, PARTICULARLY CIGARETTES

[75] Inventors: Walter Spada, Marzabotto; Gianfranco Isani, Caluso, both of Italy

[73] Assignee: SASIB S.p.A., Bologna, Italy

[21] Appl. No.: 462,592

[22] Filed: Jun. 5, 1995

[30] Foreign Application Priority Data

Jun. 16, 1994 [IT] Italy ..... GE94A0080

[51] Int. Cl.[6] ..... B65B 57/10; B65B 19/30

[52] U.S. Cl. ..... 53/54; 53/494; 209/535

[58] Field of Search ..... 53/54, 53, 52, 53/495, 494, 493, 252, 251; 73/865.8; 209/535, 536

[56] References Cited

U.S. PATENT DOCUMENTS

| | | | |
|---|---|---|---|
| 2,008,870 | 7/1935 | Little | 53/54 X |
| 3,520,394 | 7/1970 | Seragnoli . | |
| 3,628,309 | 12/1971 | Seragnoli | 53/54 X |
| 4,209,955 | 7/1980 | Seragnoli | 53/54 |
| 4,511,045 | 4/1985 | Seragnoli | 53/54 X |
| 4,607,477 | 8/1986 | Hinchcliffe et al. | 53/54 X |
| 5,101,609 | 4/1992 | Cook | 53/54 X |

FOREIGN PATENT DOCUMENTS 509355 9/1930 Germany .

*Primary Examiner*—James F. Coan
*Attorney, Agent, or Firm*—Larson and Taylor

[57] ABSTRACT

A machine for packaging fragile cylindrical products, particularly cigarettes, comprising a unit for forming and transporting ordered groups of cigarettes, and a station for transferring the groups to a following processing unit by mean synchronized with the forming and transporting unit. Means of checking the correct formation of the ordered groups of cigarettes are provided before the transfer station. Between the checking means and the station there are provided ejection means which are identical to the transfer means and are operated in phase by a single common operating mechanism in the transfer and ejection strokes. The ejection means are always operated in conjunction with the transfer means and they at least are additionally movable, under the control of the checking means, transversely with respect to the ejection stroke to a position where they do not interfere with the groups of cigarettes.

16 Claims, 6 Drawing Sheets

MACHINE FOR PACKAGING FRAGILE CYLINDRICAL PRODUCTS, PARTICULARLY CIGARETTES

BACKGROUND AND SUMMARY OF THE INVENTION

The invention relates to a machine for packaging fragile cylindrical products, particularly cigarettes, comprising:

a unit for forming ordered groups of cigarettes, particularly according to the arrangement which they are intended to have in the packet, and for transporting the ordered groups of cigarettes;

a station for transferring the ordered groups, one at a time and successively, to a unit for combination with a first wrapping slip, to which transfer station the ordered groups of cigarettes are supplied successively from the forming and transport unit;

means of transferring the ordered groups of cigarettes, synchronized with the unit for forming and transporting the ordered groups;

means of checking the correct formation of the ordered groups of cigarettes, these means being provided along the transport path of the ordered groups before the transfer station;

means of ejecting incorrectly formed groups of cigarettes, these means being disposed along the transport path of the ordered groups of cigarettes, in a position intermediate between the checking means and the transfer station, and being controlled by the checking means so that their operation is synchronized with the forming and transport unit when an incorrectly formed group of cigarettes is detected.

To ensure high output, in other words a large number of packets of cigarettes per unit of time, packaging machines of the said type have to be driven at very high operating speeds. This entails considerable difficulties of synchronization and requires arrangements capable of ensuring that the conditions for synchronization are maintained in time and within the required precision limits. The high operating speed of the individual units which operate in a reciprocating way also entails dynamic problems, since inertial masses have to be accelerated and decelerated with high frequency and precision, and therefore attempts are made to keep these masses advantageously limited. The achievement of these objects frequently obliges manufacturers to adopt extremely complex and expensive solutions, which make the machines significantly sensitive to problems of malfunctioning and which also complicate maintenance and servicing operations.

The object of the invention is therefore to provide a packaging machine of the type described initially, with which, owing to simple and relatively inexpensive arrangements, it is possible to obtain a high operating speed and more compact construction with a lower inertial mass, while ensuring the necessary synchronization for long periods and without excessively limiting the possibility of executing maintenance and servicing operations.

The invention resolves this problem with a packaging machine of the type described initially in which the means of transfer from the forming and transport unit to the unit for combination with the first wrapping slip and the means of ejecting incorrectly formed groups of cigarettes are made substantially identical to each other and are operated in phase with each other by a single common operating mechanism in the transfer and ejection strokes and the return strokes, the ejection means being additionally movable transversely with respect to the ejection stroke by associated means of diverting the ejection stroke from a trajectory in which the ejection means interact with the group of cigarettes to be ejected to a trajectory in which they do not interfere with the group of cigarettes, these diverting means being controlled by the cigarette group checking means in synchronization with the advance of the tubular housings.

The ejection means and the transfer means are made in such a way that they move in identical strokes for transferring and ejecting groups of cigarettes, the strokes being synchronized in phase, rectilinear and parallel to each other, in a predetermined plane, while the ejection means are additionally movable in the direction of a component of motion transverse to the ejection stroke by means of an operating mechanism which is controlled by the checking means and which diverts the ejection stroke to a plane which is moved laterally, and particularly vertically, out of alignment with the group of cigarettes.

When the means of forming the groups of cigarettes consist of what is known as a tray conveyor, in other words a continuous conveyor belt provided with a plurality of tubular housings for the ordered groups of cigarettes, these housings being made to advance in steps and being open at their ends which are laterally orientated with respect to the direction of transport, the transfer stroke and ejection stroke are executed in the direction of the axes of the housings perpendicular to the said ends, the transfer means and the ejection means being disposed coaxially with the open ends of the housings at points which are spaced apart in the direction of transport along the tray conveyor, and at which the housings are in the stopping phases between the advance steps.

To provide a higher operating speed of the machine by limiting the stopping phase to the time required for the execution of the ejection and transfer stroke only, the ejection and transfer means are provided with a pushing beam whose shape is complementary to that of the transverse section of the tubular housings and which is carried on and projects from a thin supporting stem orientated transversely and preferably perpendicular to the upper free surface of the housings and to the transfer or ejection stroke, while the housings are provided with a slit for the passage of the said stem, the slit being orientated in the direction of the transfer or ejection stroke and extending from one end to the opposite end of each housing. The transfer and ejection stroke is such that at the end point of the ejection and transfer stroke both the supporting stem and the pushing beam are disengaged from the housing. The transfer means are also made movable in the direction of an additional component of motion transverse with respect to the transfer stroke, by diverting means separate from those of the ejection means, in such a way that the transfer means execute the return stroke in a trajectory in which they do not interfere with the housings.

In a preferred embodiment, the transfer means and the ejection means comprise a push bar which is orientated in the direction of the transfer and ejection stroke and which at its end facing the housings carries the stem and pushing beam, this push bar being hinged to an articulated quadrilateral for providing the transfer and ejection strokes and the corresponding return strokes along a rectilinear path, while the said push bar, together with the said articulated quadrilateral, also forms part of an articulated parallelogram, the articulated quadrilaterals of the transfer means and of the ejection means and the associated articulated parallelograms being identical to each other and being provided with transmission arms operated in synchronization by a common operating mechanism, while each articulated parallelogram has a rocker arm parallel to the transmission arm of the articulated quadrilateral, at least the rocker arm of the ejection means being pivoted on an axle which is movable transversely with respect to the ejection stroke by means of its own operating mechanism. The rocker arm of the articulated parallelogram of the transfer means is also pivoted on an axle which is movable substantially transversely with respect to the transfer stroke and which is operated by a separate operating mechanism.

The advantages of the present invention will be clear from the above description. The ejection means and the transfer means are made so that they are substantially identical to each other and move along identical paths in full synchronization of phase with each other, in the conditions of operation of the ejection means. To obtain the necessary synchronization with the stopping phases of the ordered groups along the transport path at the transfer station, it is therefore sufficient to synchronize only three operating mechanisms, namely the common operating mechanism of the transfer and ejection stroke and the corresponding operating mechanisms for the transverse movement. In particular, since the transfer means are operated continuously, while the ejection means are activated only irregularly, the motion for the transverse movement of the return stroke of the transfer means with respect to the transfer stroke may be obtained from a single motor which is also common to the operating mechanism of the transfer stroke, by using suitable synchronized transmission means. In addition to the reduction of inertial mass due to this particular embodiment, the mass is further limited by the construction of the transfer and ejection means in the form of articulated quadrilaterals associated with articulated parallelograms, thus providing considerable simplicity of construction and reliability of operation.

The invention also relates to other characteristics which further improve the packaging machine described above and which form the subject of the subsidiary claims.

BRIEF DESCRIPTION OF THE DRAWINGS

The particular characteristics of the invention and the advantages derived therefrom will be more clearly understood from the description of some preferred embodiments, illustrated by way of example and without restriction in the attached drawings, in which.

DESCRIPTION OF THE PREFERRED EMBODIMENT OF THE INVENTION

Figure 1:
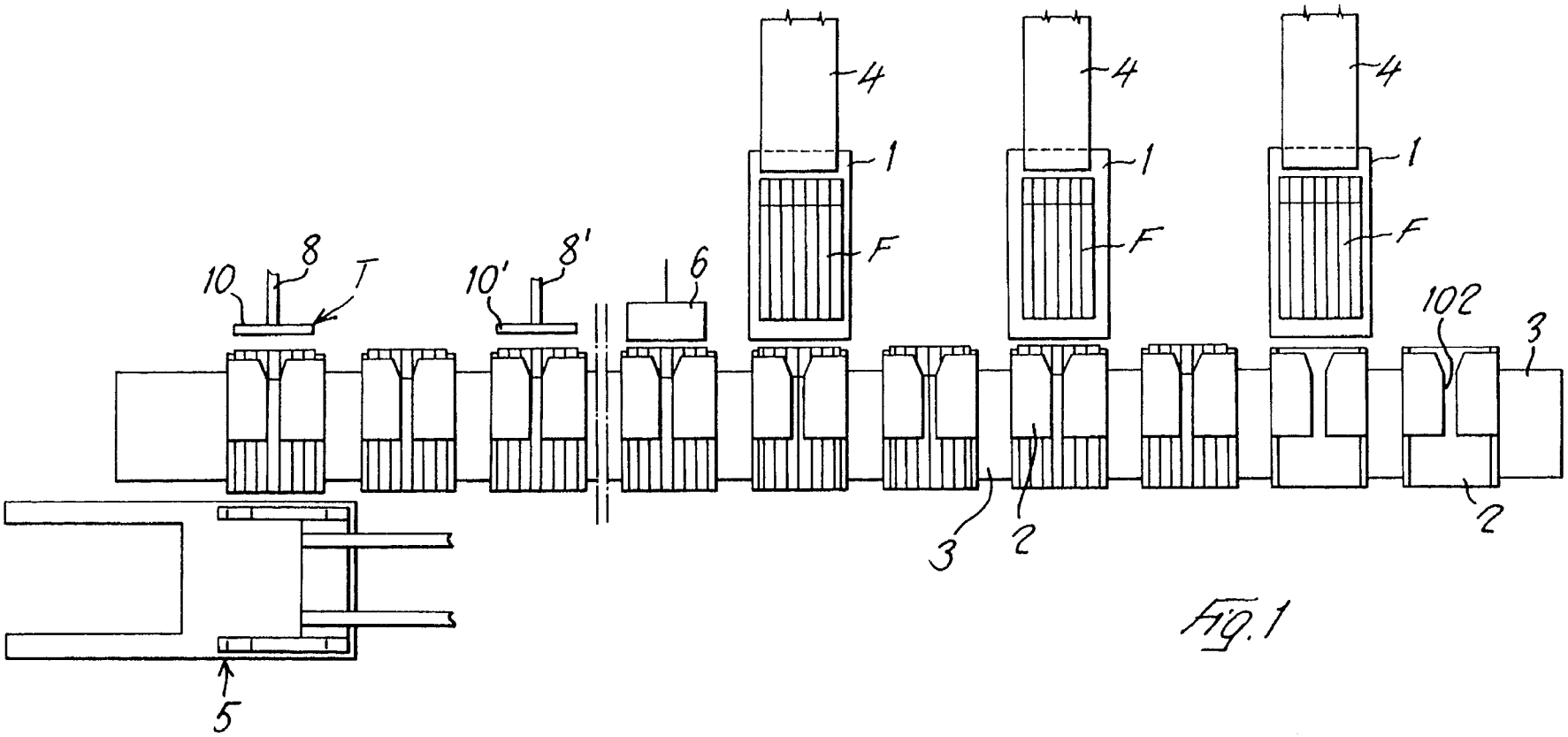
FIG. 1 is a schematic plan view from above of the unit for forming and transporting the ordered groups of cigarettes of a packaging machine with the associated transfer means and ejection means.
Figure 5:
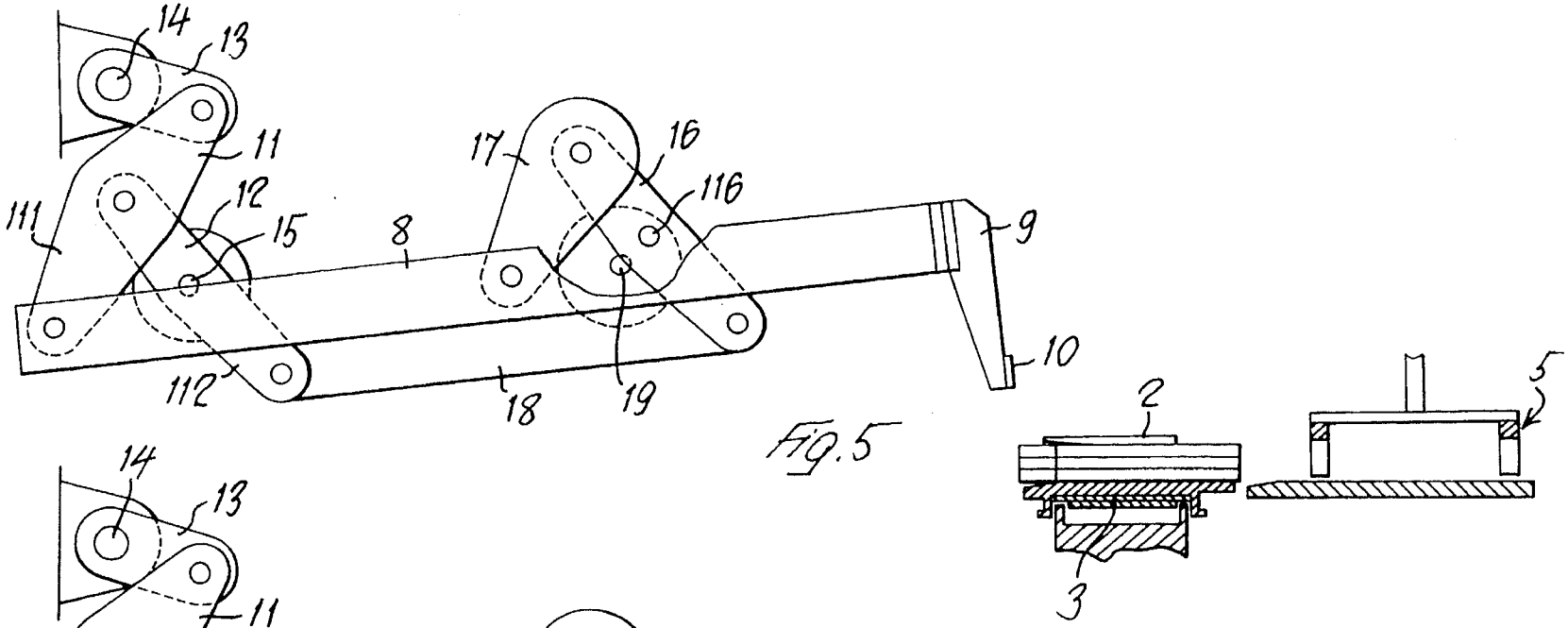
FIGS. 2 to 5 are schematic side views of the transfer means only in four end positions of the transfer and return stroke along a path in the direction of two components of motion which are perpendicular to each other.

With reference to FIG. 1, a cigarette packaging machine comprises a vertical feed hopper (not shown), in which the loose cigarettes are contained. The feed hopper has three discharge apertures, each for one row of cigarettes lying side by side. The discharge apertures deposit the rows F of cigarettes on a corresponding discharge plane 1. The discharge planes 1 are provided on three different levels which are staggered with respect to each other in a progression with an interval corresponding to or slightly greater than the cigarette diameter. The three rows F of cigarettes are discharged on to the corresponding planes 1 which lie side by side and in positions coinciding with the stopping places of tubular housings 2 which are carried by a continuous conveyor belt 3 disposed out of alignment in the direction of the axes of the cigarettes and with its longitudinal axis parallel to the three rows F of cigarettes aligned with each other. The upper conveyor run of the belt 3 extends at such a level with respect to the discharge planes 1 of the rows F of cigarettes that the tubular housing 2, which is open at its ends oriented transversely with respect to the cigarettes, becomes substantially coplanar with the first discharge plane 1, with respect to the direction of transport. Each tubular housing 2 is therefore filled progressively with a row of cigarettes which is disposed on top of that fed previously. For this purpose, pushing means 4 are provided on the opposite sides of the rows of cigarettes to insert the rows F of cigarettes axially into the tubular housings, these means being operated in synchronization with the stopping phases of the tubular housings 2 between the advance steps.

The conveyor belt 3 carries each ordered group formed as above to a transfer station indicated by the arrow T, at which the ordered groups of cigarettes are transferred to a unit indicated in a general way by the number 5 and not illustrated in detail since it is not the subject of the present invention. This unit combines a wrapping slip with the ordered group of cigarettes and feeds the group of cigarettes together with the wrapping slip to a following unit (not illustrated) for folding the said slip around the cigarettes.

At the transfer station T, the group of cigarettes is discharged from the tubular housing 2 and transferred to the said unit 5 by a movement axial with respect to the cigarettes through the open end of the housing 2 opposite the discharge plane 1, and transfer means, illustrated only partially in FIG. 1 are provided for this purpose. In the section of the transport path of the ordered groups of cigarettes between the discharge plane 1 of the final, uppermost row F of cigarettes which is fed to the tubular housings 2 and the transfer station T, there are provided, in a position coinciding with one or both of the open ends of the tubular housings 2 in the stopping position between one advance step and the next, sensors 6 for checking the correct formation of the ordered group of cigarettes. The checking sensors 6 are generally known and may be made in any way. At an intermediate point of the path of the transport of the groups of cigarettes between the transfer station T and the checking sensors 6, and in a position coinciding with the housings 2 during a stopping phase, there are provided means of ejecting incorrectly formed groups of cigarettes, these means being normally inactive, but operated under the control of the checking sensors 6 in synchronization with the stopping phases of the housings 2. The ejection means are made in a similar way to the transfer means and push the incorrectly formed group of cigarettes in the direction of the axis of the cigarettes out of the housings 2 through the end opposite the hopper.

FIGS. 2 to 5 show the construction of the transfer means and different positions of their operating stroke.

The transfer means comprise a push bar 8 which is orientated axially with respect to the cigarettes, in other words in the transfer direction, and which carries, at the lower free end of a downward-projecting transverse stem 9, a projecting pushing beam 10 orientated parallel to the end of the tubular housing 2 and having a shape complementary to or slightly smaller than the transverse section of the housing. The vertical stem 9 advantageously consists of a flat strip disposed with its faces parallel to the direction of transfer of the cigarettes.

The end opposite the tubular housings 2, in other words the rear end, of the push bar 8 is hinged to an extension 111 of an intermediate arm 11 of an articulated quadrilateral which connects a transmission arm 12 to a driven arm 13 of the said articulated quadrilateral. The driven arm is pivoted freely on a static axle 14, while the transmission arm 12 is fixed to a driving shaft 15 so that it rotates with the shaft. The push bar 8 is hinged at an intermediate position to a link 17 which is parallel to the intermediate connecting arm 11 of the articulated quadrilateral and whose opposite end is hinged in turn to a rocker arm 16 parallel to the transmission arm 12 of the articulated quadrilateral. The opposite end of the rocker arm 16 extends beyond the push bar 8 and on the lower, opposite side is hinged to a connecting arm 18 which is parallel to the push bar 8 and which is hinged at its other end to a lower extension 112 of the transmission arm 12 of the articulated quadrilateral. The link 17, the rocker arm 16, the connecting arm 18, the push bar 8 and the transmission arm 12, together with the connecting arm 11, thus form an articulated parallelogram 11, 111, 12, 112, 15, 8, 17, 16, 116, 18 coupled to the articulated quadrilateral 11, 12, 13, 14, 15. The rocker arm 16 is pivoted at an intermediate point 116 so that it can oscillate about an axle which is supported eccentrically with respect to a driving shaft 19, parallel to the driving shaft 15 of the transmission arm 12, the axes of the two driving shafts 15 and 19 being contained in the same horizontal plane parallel to the horizontal plane in which the transfer stroke is executed.

The construction of the ejection means is identical to that of the transfer means in respect of the push rod 8', the supporting stem, the pushing beam 10', the articulated quadrilateral 11', 12', 13', 14', 15' and the coupled articulated parallelogram 11', 111', 12', 112', 15', 8', 17', 16', 116', 18'. The articulated quadrilaterals and articulated parallelograms are also provided in such a way that they are operated in the same phase, at least in respect of the transfer and ejection strokes and the corresponding return strokes.

Figure 6:
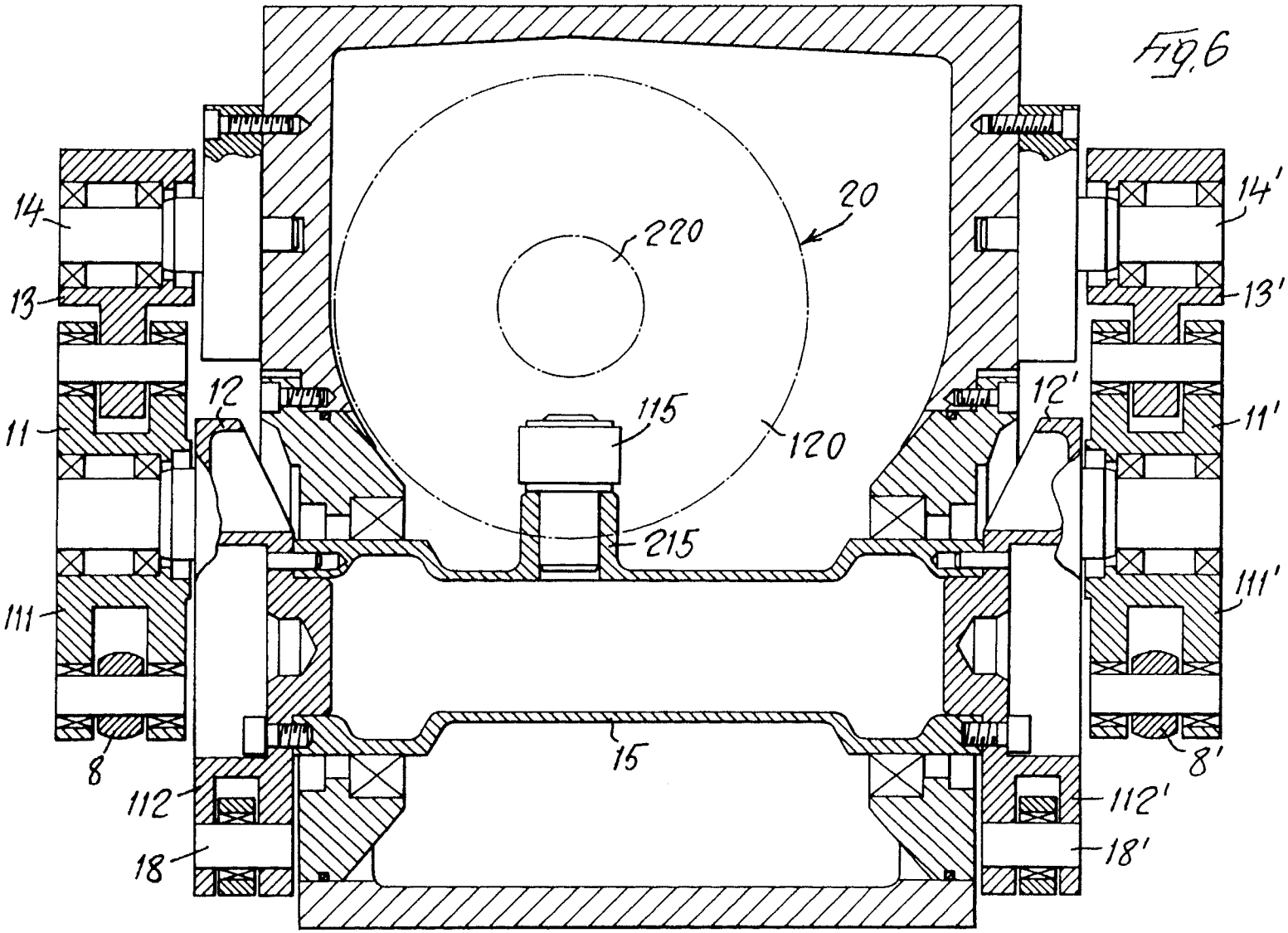
FIG. 6 is a section transverse with respect to the transfer and ejection stroke of the transfer means and ejection means, in a plane passing through the pivot axis of the transmission arm of the articulated quadrilateral for executing the transfer and ejection stroke.

The articulated quadrilateral of the transfer means and ejection means is responsible for the execution of the transfer stroke and ejection strokes and the corresponding return strokes. As shown in FIG. 6, the transmission arms 12 and 12' of the transfer means and of the ejection means are operated by a common operating mechanism. For this purpose, the transfer means and the ejection means are disposed side by side and parallel to each other, the operating mechanism of the transfer stroke and of the ejection stroke, in other words that of the transmission arms 12, 12' of the two articulated quadrilaterals, being disposed in an intermediate position between them. The two transmission arms 12, 12' are fixed at the ends of a common driving shaft 15, in positions where they are completely parallel to and in phase with each other. The driving shaft 15 is operated by a cam with helical tracks, indicated by the number 20, known as a cylindrical cam, in which tracks 120 the driving shaft 15 is engaged by means of two rollers 115 rotating coaxially on radial arms 215 located at an angle to each other. The helical tracks 120 are made in such a way that with certain angles of rotation of the cylindrical cam the driving shaft 15 is subjected to a predetermined angular movement in one direction, a predetermined stopping phase, a subsequent angular movement in the opposite direction, and another stopping phase, before repeating the predetermined angular movement of the preceding initial step.

Figure 7:
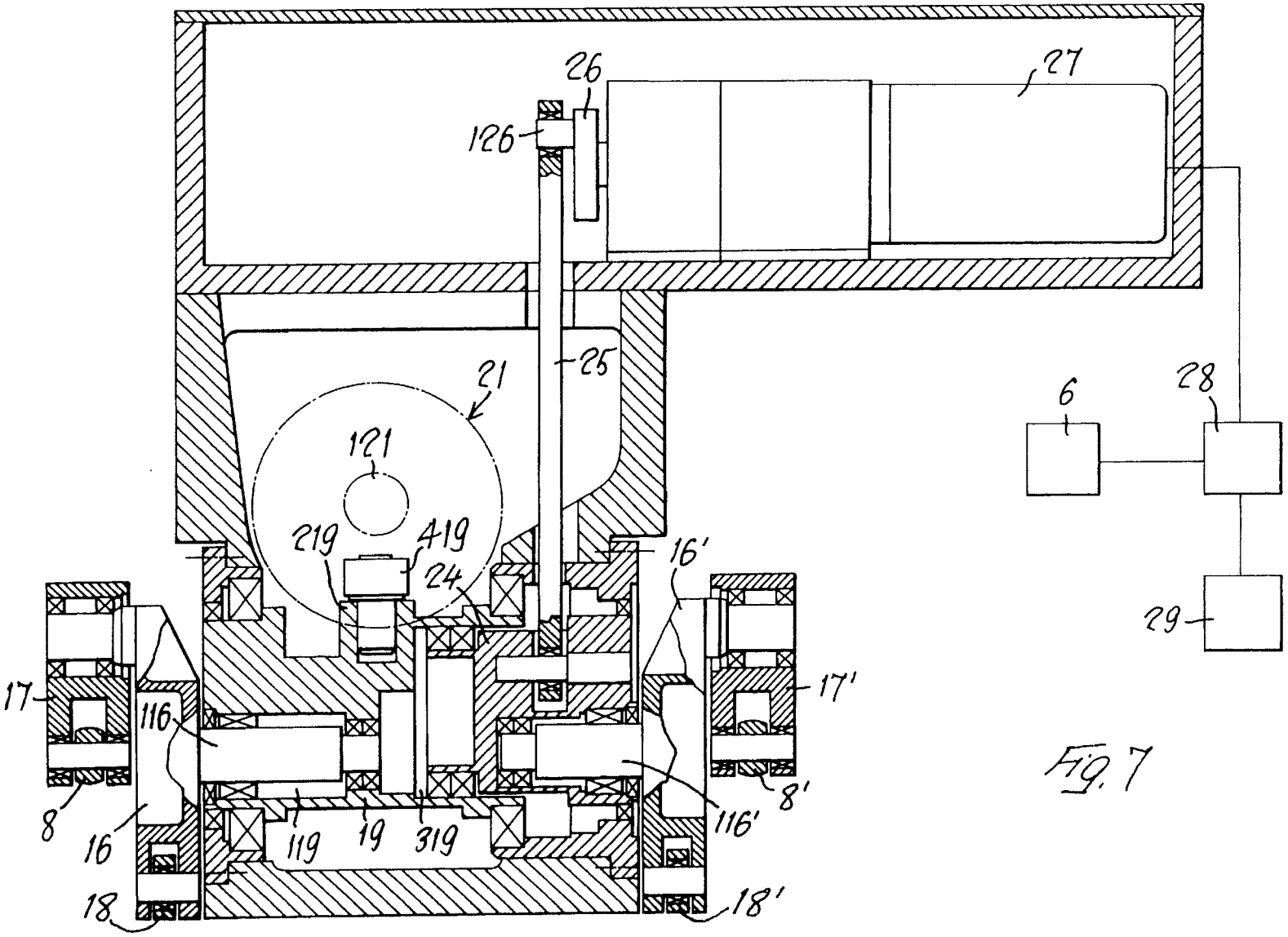
FIG. 7 is a view similar to FIG. 5, in a transverse plane passing through the pivot axis of the rocker arms of the articulated parallelogram of the transfer means and ejection means.
Figure 8:
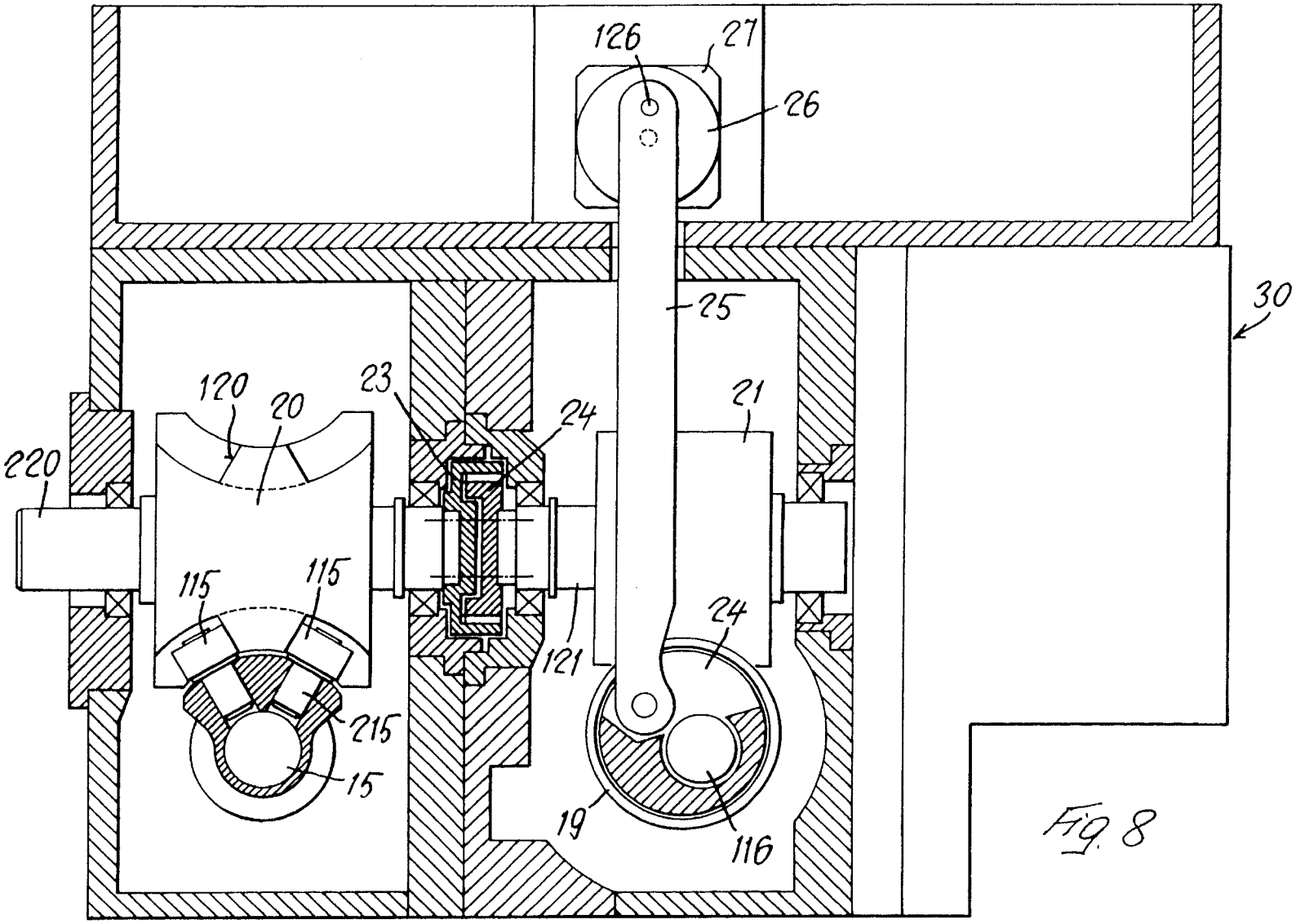
FIG. 8 is a section in a plane transverse with respect to the pivot axes of the transmission arm and the rocker arm of the articulated quadrilateral and the associated articulated parallelogram of the ejection means.

In the pivot area of the rocker arm 16, 16' of the transfer means and ejection means (FIG. 7) there is provided an intermediate driving shaft 19 for transverse motion with respect to the transfer stroke, this shaft being substantially similar to the driving shaft 15 for the transfer stroke and being disposed parallel to the latter with its axis of rotation in the same horizontal plane as the driving shaft 15. The rocker arm 16 of the transfer means is fixed on a pivot shaft 116 which is engaged so that it is freely rotatable about its axis in an eccentric socket 119 in the corresponding end of the transverse driving shaft 19. A rotation of the transverse driving shaft 19 causes the pivot point of the rocker arm to move transversely with respect to the transfer stroke, enabling the pushing beam to move according to two components of motion which are perpendicular to each other, one of these being horizontal and one vertical. The transverse driving shaft 19 also has two radial arms 219 which are located at an angle to each other and which interact with a cylindrical cam 21, similar to the cam 20 interacting with the driving shaft of the transfer stroke 15, by means of a roller 419. The cam 21 interacting with the transverse driving shaft 19 is mounted on a shaft 121 coaxial with the shaft 220 of the cam 20. The two shafts 121, 220 are coupled so that they rotate together by means of a pair of ring gears 22, 23, one internal and one external, which are fixed on the facing ends of the corresponding shafts 121, 220 of the cams 20, 21. Additionally, the cam 21 is shaped in such a way that the transverse stroke of the pushing beam 10 is executed in synchronization with a predetermined phase with respect to the transfer stroke and the corresponding return stroke.

The rocker arm 16' of the ejection means has a similar oscillating shaft 116' which is mounted eccentrically, in a similar way to the pivot shaft 116 of the rocker arm 16 of the transfer means, on a hub 24 which is housed so that it is freely rotatable coaxially with the transverse driving shaft 19 in a coaxial cavity 319 provided in the end of the shaft facing the ejection means. A transmission rod 25 is hinged eccentrically and in a position substantially diametrically opposite the pivot shaft 116' of the rocker arm 16', to the hub 24, and its other end is pivoted rotatably about an eccentric crank pin 126 of a disc 26 which is fixed coaxially on the shaft of a motor 27. The motor 27 is controlled by the checking sensor means 6, and its operation causes a transverse movement of the pivot of the rocker arm 16' with respect to the ejection stroke of the ejection means, with an effect similar to that of the transfer means. By these arrangements, the transverse movements of the pivots 116, 116' of the rocker arms 16, 16' of the transfer means and of the ejection means may be executed independently of each other, while the operation of these means in the direction of transfer and ejection and of the corresponding return strokes is common and always fully synchronized.

Advantageously, in order to ensure full synchronization of the transfer and ejection means with the advance steps of the conveyor 3, the motive power of the conveyor may also be obtained from the operating motor of the cams 20, 21. In particular, this may be done by means of an intermittent oscillating drive with conjugate flat cams of a known type, indicated by 30 and not illustrated in detail, whose input shaft is connected dynamically to the end of the shaft 121 of the cam 21 opposite the cam 20, and whose output shaft drives a return pulley of the conveyor 3.

The motor 27 providing the transverse movement of the pivot axis of the rocker arm 16' may be synchronized by transducer means for detecting the angle of rotation of the main driving shaft of the cams 20, 21 and of the intermittent drive of the conveyor 3, namely what is known as a tacheometric transducer 29 in combination with a controller 28 to which the signals sent from the checking sensors 6 are also supplied.

Figure 2:
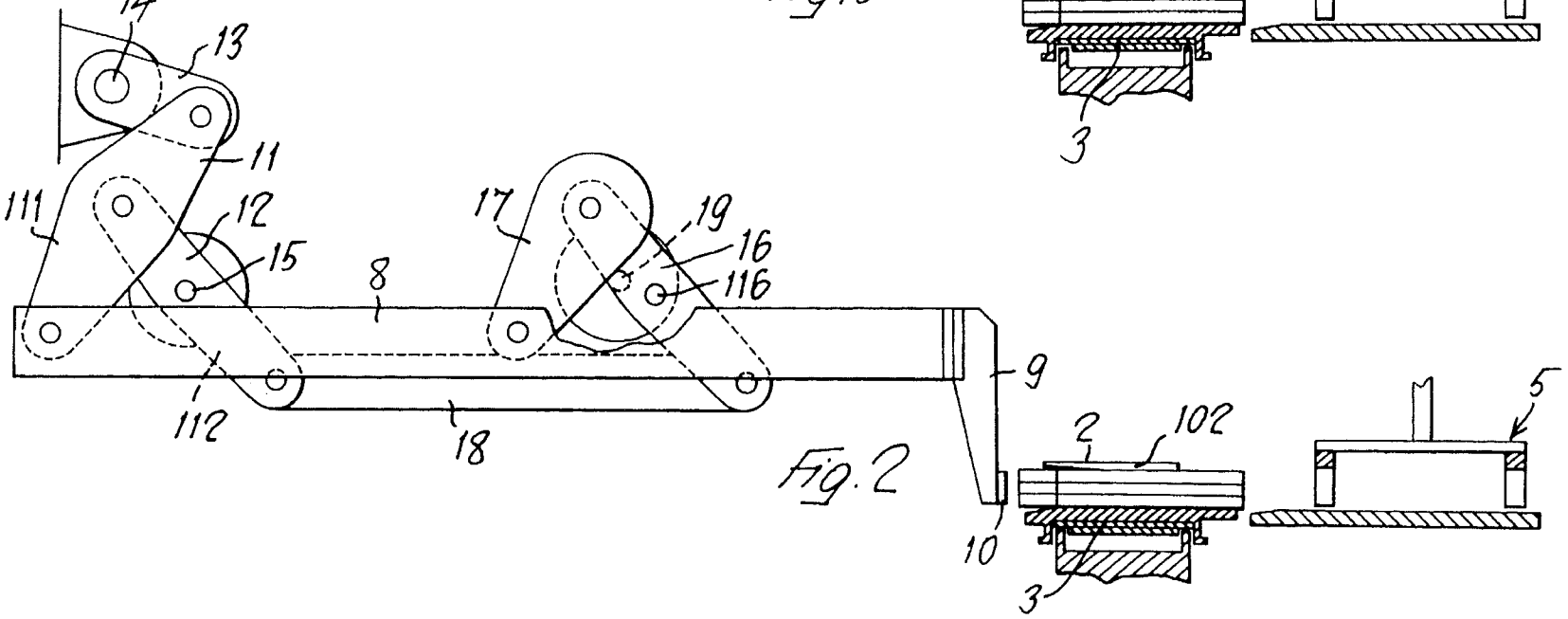
Figures 3, 4:
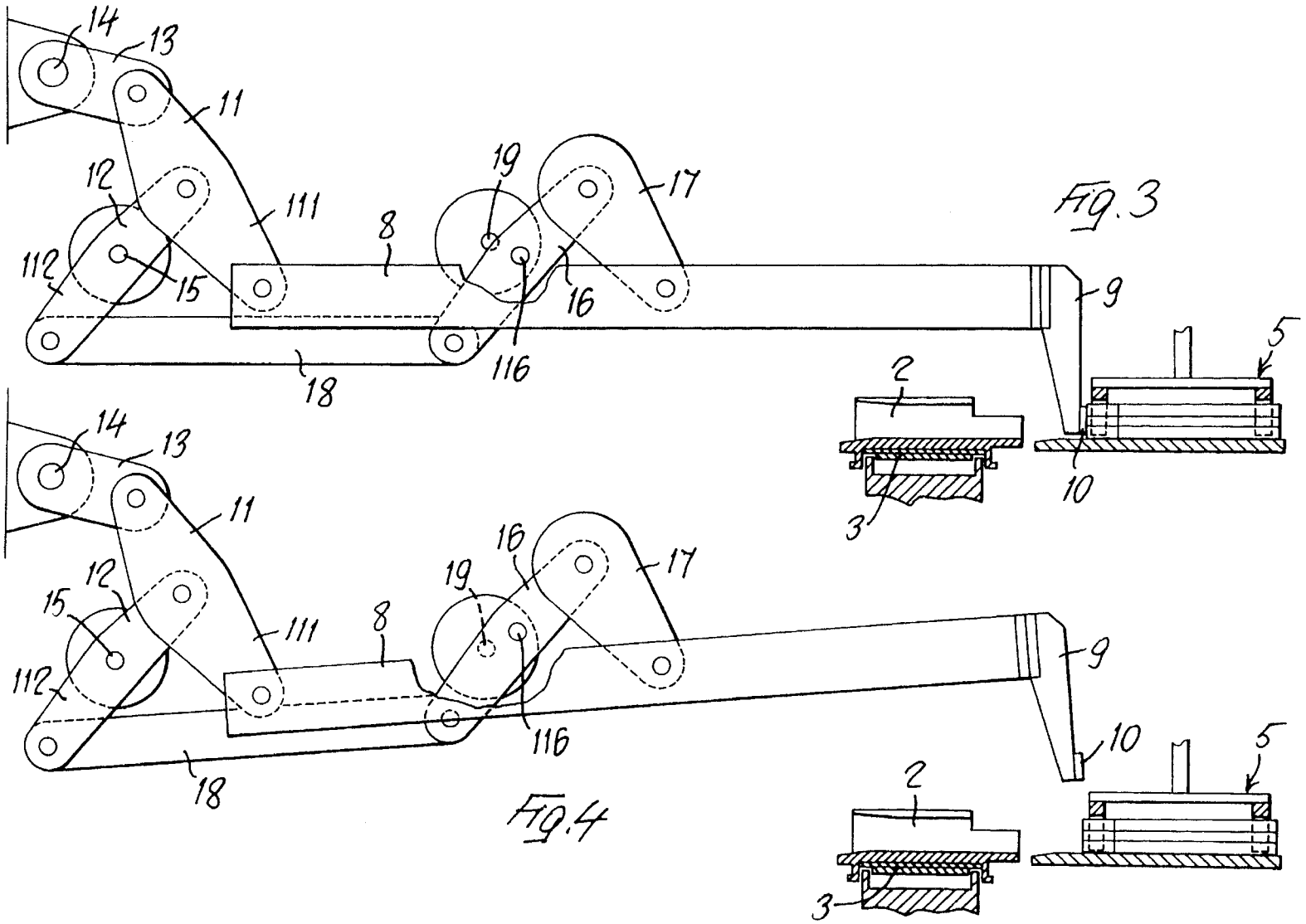

Each tubular housing 2 is provided, in an aligned position in the plane in which the supporting stems 9 of the pushing beams 10, 10' of the transfer means and ejection means are moved, with a continuous slit 102 which extends from one end to the opposite end of the upper surface of the tubular housing 2, and through which the stem 9 is guided during the transfer and ejection stroke. The transfer stroke and, when the ejection means are operated, the ejection stroke are simultaneous and parallel to each other. The pushing beam 10 of the transfer means and the beam 10' of the ejection means are moved in a rectilinear path coaxial with the tubular housing 2 which is in the resting position coincident with the beam. The length of the transfer and ejection strokes is such that the stem 9 and the pushing beam 10, 10' are disengaged from the tubular housing 2 at the rear end of the tubular housing, with respect to the direction of transfer and ejection. With reference to FIG. 3 for the transfer means, the ordered group of cigarettes has been transferred from the tubular housing 2 into the following unit 5. In this condition, the pushing beam 10 may be raised above the tubular housing 2 into a position in which it does not interfere with the housing, the pivot axle of the rocker arm 16 of the transfer means (FIG. 3) being moved suitably by the rotation, by means of the suitably shaped cylindrical cam 21, of the transverse driving shaft 19, while, when the transverse stroke of the pushing beam 10 has reached its upper end point, the transmission arm 12 of the articulated quadrilateral of the transfer means is operated in the opposite direction, so that the push bar 8 is moved backwards on a rectilinear path substantially parallel to the transfer stroke but at a higher level. The return stroke terminates when the pushing beam 10 is disposed beyond the front end of the tubular housing 2 with respect to the transfer stroke. The pushing beam 10 is brought to the position coinciding with the said end of the tubular housing 2 by the subsequent operation in the opposite direction of the transverse driving shaft 19 by which the pivot axle of the rocker arm 16 is moved downwards again (FIG. 2). During the return stroke the tray conveyor 3 executes an advance step so that, when the pushing beam 10 has returned to the initial position of the transfer stroke, a new tubular housing 2 is located next to it.

The ejection means execute a similar movement when operated under the control of the checking sensors 6. In this case, the transverse movement of the pivot axle of the rocker arm 16' required for the execution of the return stroke along a plane higher than the tubular housings 2 is provided by the motor 27 in combination with the transmission rod 25 and the hub 24, instead of by the transverse driving shaft 19. In the inactive condition of the ejection means, the transverse driving means 24, 25, 26, 27 hold the pivot axle of the rocker arm 16' in the position of the pushing beam 10' raised above the tubular housings 2. Since the articulated quadrilateral of the ejection means, and therefore the transmission arm 12' of these means, is connected permanently to the driving shaft 15, this shaft is continuously driven and the pushing strip executes both the ejection and the return stroke along the same path above the tubular housings 2, passing alternately and directly from one to the other of the end positions corresponding to those of the transfer means according to FIGS. 3 and 4. When the checking sensor 6 detects an incorrectly formed group, it causes the synchronized activation of the motor 27 in such a way that the ejection means, and therefore the pushing beam 10', execute a movement over a path identical to that of the transfer means and perfectly synchronized in phase.

Naturally, the invention is not limited to the embodiments described and illustrated herein, but may be widely varied and modified, especially in respect of construction, without departure from the guiding principle described above and claimed below.

What is claimed is:

1. Machine for packaging fragile cylindrical products, particularly cigarettes, comprising:

a unit for forming ordered groups of cigarettes, particularly according to the arrangement which they are intended to have in a packet, and for transporting the ordered groups of cigarettes;

a station for transferring the ordered groups, one at a time and successively, to a unit for combination with a first wrapping slip, to which transfer station the ordered groups of cigarettes are supplied successively from the forming and transport unit;

means of transferring the ordered groups of cigarettes, synchronized with the unit for forming and transporting the ordered groups;

means of checking the correct formation of the ordered groups of cigarettes being provided along the transport path of the ordered groups before the transfer station;

means of ejecting incorrectly formed groups of cigarettes being disposed along the transport path of the ordered groups of cigarettes, in a position intermediate between the checking means and the transfer station, and being controlled by the checking means so that their operation is synchronized with the forming and transport unit when an incorrectly formed group of cigarettes is detected, in which:

the said means of transfer from the forming and transport unit to the unit for combination with the first wrapping slip and the means of ejecting incorrectly formed groups of cigarettes are made substantially identical to each other and are operated in phase with each other by a single common operating mechanism in the transfer and ejection strokes, which are executed along rectilinear trajectories, and in the return strokes, the ejection means being additionally movable transversely with respect to the ejection stroke by associated means of diverting the ejection stroke from the rectilinear trajectory, in which the ejection means interact with the group of cigarettes to be ejected, to a trajectory in which they do not interfere with the group of cigarettes, these diverting means being controlled by the cigarette group checking means in synchronization with the advance of the groups of cigarettes, while the said ejection means are operated continuously together with the transfer means in the ejection stroke and in the corresponding return stroke.

2. Machine according to claim 1, in which the ejection means and the transfer means execute transfer and ejection strokes and corresponding return strokes which are parallel to each other and are synchronized in phase with each other, while the ejection means are additionally movable in the direction of a component of motion transverse to the ejection stroke by means of an operating mechanism which is controlled by the checking means and which diverts the ejection stroke to a plane which is moved laterally, and particularly vertically, out of alignment with the group of cigarettes.

3. Machine according to claim 2, in which the units for forming and transporting the groups of cigarettes consist of a tray conveyor, comprising a continuous conveyor belt with a horizontal transporting run provided with a plurality of tubular housings for the ordered groups of cigarettes, these housings being made to advance in steps and being open at their ends which are orientated laterally with respect to the direction of transport, while the transfer means and the ejection means execute a transfer and ejection stroke in the direction of the axis of the housings perpendicular to the said open ends, the transfer means and the ejection means being disposed coaxially with the open ends of the housings at points which are spaced apart in the direction of transport along the tray conveyor, and at which the housings are in the stopping phases between the advance steps, while the trajectory along which the ejection means execute the ejection stroke and the return stroke is made to be in a substantially horizontal plane above the tubular housings.

4. Machine according to claim 3, in which the ejection means and the transfer means are provided with a pushing beam whose shape is complementary to that of the transverse section of the tubular housings and which is carried on and projects from a thin supporting stem orientated transversely and preferably perpendicularly to the upper free surfaces of the housings and to the transfer or ejection stroke, while the housings are provided with a slit for the passage of the said stem, the slit being orientated in the direction of the transfer and ejection strokes and extending from one end to the opposite end of each housing, the transfer and ejection stroke being such that at the end point of the ejection and transfer strokes both the supporting stem and the pushing beam are disengaged from the tubular housing, while the transfer means are also made movable in the direction of a component of motion transverse with respect to the transfer stroke, by diverting means separate from those of the ejection means, in such a way that the transfer means execute the return stroke in a trajectory in which they do not interfere with the tubular housings, preferably in a substantially horizontal plane above the tubular housings.

5. Machine according to claim 1 in which the said transfer means and the ejection means comprise a push bar which is orientated in the direction of the transfer and ejection strokes and which at its end facing the tubular housings carries the stem and pushing beam, this push bar being hinged to an articulated quadrilateral for providing the transfer and ejection strokes and the corresponding return strokes along a rectilinear path, while the said push bar together with the said articulated quadrilateral also forms part of an articulated parallelogram, the articulated quadrilaterals of the transfer means and of the ejection means and the associated articulated parallelograms being identical to each other and being provided with transmission arms operated in synchronization by a common operating mechanism while each articulated parallelogram has a rocker arm parallel to the transmission arm of the articulated quadrilateral, at least the rocker arm of the ejection means being pivoted on an axle which is movable transversely with respect to the ejection stroke by means of its own operating mechanism.

6. Machine according to claim 5, in which the rocker arm of the articulated parallelogram of the transfer means is also pivoted on an axle which is movable substantially transversely with respect to the transfer stroke and which is operated by a separate operating mechanism.

7. Machine according to claim 6, in which the motion for the transverse movement of the pivot axle of the rocker arm of the transfer means is obtained from a single motor which is also common to the operating mechanism of the transfer stroke, by using suitable synchronized transmission means.

8. Machine according to claim 1, in which articulated quadrilaterals and articulated parallelograms of the transfer means and of the ejection means are disposed in vertical planes orientated in the direction of the transfer and ejection strokes and parallel to each other, the two transmission arms of the corresponding articulated quadrilaterals being fixed at the opposite ends of a common driving shaft for the transfer stroke and the ejection stroke, the shaft being interposed between the transfer means and the ejection means and having a length corresponding to the predetermined distance between the ejection means and the transfer means.

9. Machine according to claim 8, in which the driving shaft of the ejection and transfer strokes is provided with at least two radial arms located at an angle to each other and having coaxial rollers engaging with helical tracks of a cylindrical cam mounted on a shaft orientated parallel to the transfer and ejection strokes.

10. Machine according to claim 1, in which there is provided, in the area in which a rocker arm is hinged to a push rod, a driving shaft for the transverse stroke, this shaft being orientated parallel to the driving shaft for the transfer and ejection stroke, and being aligned horizontally with the latter, while a pivot shaft of the rocker arm of the transfer means is engaged eccentrically in the corresponding end of the driving shaft for the transverse stroke so that it is freely rotatable about its axis.

11. Machine according to claim 10, in which the rocker arm of the ejection means is engaged eccentrically in, and can oscillate freely with respect to, a hub with a pivot shaft, the hub being engaged coaxially and so that it is freely rotatable in the corresponding end of the driving shaft for the transverse stroke, while, in a position substantially diametrically opposite the pivot shaft of the rocker arm, a transmission rod is hinged eccentrically to the hub, the other end of the transmission rod being hinged eccentrically to the shaft of a motor for generating the transverse stroke of the ejection means.

12. Machine according to one claim 1, in which a driving shaft for the transverse stroke of the transfer means engages, by means of rollers mounted coaxially and rotatably on at least two radial arms located at an angle to each other, with a cylindrical cam.

13. Machine according to claim 12 in which a shaft of the cylindrical cam interacting with the driving shaft for the ejection and transfer strokes is coupled coaxially to the shaft of a cam associated with the driving shaft for the transverse stroke of the transfer means, and the said cams are made in such a way that the transfer means execute a first rectilinear transfer stroke, a subsequent stroke in which the pushing beam is raised above the tubular housings, a rectilinear return stroke above the tubular housings and a stroke in which the pushing beam is lowered to a position coinciding with the open end of a tubular housing, while a motor for providing the transverse movement of the ejection means is operated in such a way that the pushing beam of the ejection means executes raising and lowering strokes substantially identical to and simultaneous with those of the transfer means, in the presence of a control signal from the cigarette group checking means.

14. Machine according to claim 13, in which said tray conveyor is operated in synchronization with the transfer means and the ejection means, so that said tray conveyor advances by one step during the return stroke of said transfer and said ejection means.

15. Machine according to claim 14, in which said tray conveyor is operated by intermittent/oscillating drive means whose input shaft is connected dynamically to the shaft of the cylindrical cam for providing the transverse stroke or to the cam for providing the transfer and ejection strokes, while the motor for providing the transverse stroke of the ejection means is connected to a synchronizing controller to which are connected a tacheometric transducer associated with the driving motor of the cylindrical cams and sensors for checking the groups of cigarettes.

16. Machine according to claim 1, in which a transmission arm of articulated parallelograms of the transfer means and of the ejection means is connected by means of an intermediate arm to the terminal area of a push rod opposite pushing beam, while a rocker arm is hinged to the pushing beam by means of a link in an area intermediate between the transmission arm and the pushing beam.

* * * * *